United States Patent [19]

Kubo

[11] Patent Number: 4,654,659

[45] Date of Patent: Mar. 31, 1987

[54] SINGLE CHANNEL REMOTE CONTROLLED TOY HAVING MULTIPLE OUTPUTS

[75] Inventor: Takao Kubo, Tokyo, Japan

[73] Assignee: Tomy Kogyo Co., Inc, Tokyo, Japan

[21] Appl. No.: 698,244

[22] Filed: Feb. 5, 1985

[30] Foreign Application Priority Data

Feb. 7, 1984 [JP] Japan ..... 59-14903[U]

[51] Int. Cl.[4] ..... H04Q 7/00; H04B 7/00; A63H 30/04

[52] U.S. Cl. ..... 340/825.76; 446/454; 340/825.72

[58] Field of Search ..... 340/825.76, 825.69, 340/825.72, 696; 446/454, 456; 369/63; 180/167

[56] References Cited

U.S. PATENT DOCUMENTS

| | | | |
|---|---|---|---|
| 3,165,595 | 1/1965 | Norshiro . | |
| 3,912,694 | 10/1975 | Chiappe et al. | 360/79 |
| 4,080,602 | 3/1978 | Hattori et al. . | |
| 4,112,615 | 9/1978 | Ishimoto . | |
| 4,212,270 | 7/1983 | Oda . | |
| 4,334,221 | 6/1982 | Rosenhagen et al. | 340/825.72 |
| 4,349,986 | 9/1982 | Tsukuda | 340/825.69 |

OTHER PUBLICATIONS

"Two-Chip Radiolink Pilots Toys and Models", Giles et al, *Electronics*, Jun. 5, 1980, vol. 53, No. 13, pp. 145–149.

"Unicorn-1 Robot", James A. Gupton, Jr., *Radio Electronics*, Mar., 1981, vol. 52, No. 3, pp. 63–66; 82.

"Unicorn-1 Robot", James A. Gupton, Jr., *Radio Electronics*, Apr., 1981, vol. 52, No. 4, pp. 65–69; 88.

*Primary Examiner*—Donald J. Yusko

*Attorney, Agent, or Firm*—Herb Boswell

[57] ABSTRACT

A remote control toy includes a remote housing and a main housing. The remote housing has a transmitter and a signal generator associated with the transmitter. A plurality of function switches govern the signal generator. The transmitter outputs a signal which is encoded by the signal generator to reflect which switch or switches is activated on the remote housing. The main module includes a receiver to receive the signal from the transmitter. The receiver removes the encoded signal and outputs it to a decoder. Depending upon the signal received, the decoder outputs to one or more of its output ports which are connected to appropriate output devices located on the main module. One of these includes a tape drive which carries a tape therein, and which is capable of recording a sequence of control functions transmitted by the remote module to the main module. The tape can be played back at a later time period whereby the main module will output the particular sequence of control functions in response to the record of these functions stored on the tape.

17 Claims, 7 Drawing Figures

68
30
10

32L
32R
28
26
28
34
36
6:35
CLOCK
ALARM
TIME
SET
38
OFF ON TIMER
40
42
44
46
51
50
14
PAUSE
PLAY
RECORD
FAST WIND
REWIND
VOICE
DUBBING
52
54
56
58
60
62
48

+VDD
159L
159R
156
158
164
(S)
150
138
MAIN
R P
154
152
X
146
TAPE M1
148
144
140
PRE AMP
FILTER
142
162
134
(R)
(RC)+(VO) OR (PRG)+(R)
(RC)(VO)(PRG)(R)
44
42
42a
42b
42c
42d
(PRG)
132
124
126
m1
m2
VDD
130
(VO)
122
CPU
IN
40
40a
40b
(RC)
136
TIMER
ON
OFF
38
66
168
170
(S)
128
+3V
OUT1
OUT2
68
110
112
94
34
36

SINGLE CHANNEL REMOTE CONTROLLED TOY HAVING MULTIPLE OUTPUTS

BACKGROUND OF INVENTION

This invention is directed to a remote controlled toy which utilizes a single transmitting channel for controlling a plurality of output functions of the toy. Further, the toy includes a recorder for making a record of the outputs of the toy and playing back this record on a future command.

A variety of radio controlled, or remote controlled, appliances is known. With the introduction of the transistor, it became possible to economically produce radio controlled toys. In certain radio controlled toys, such as radio controlled cars and the like, wherein the number of outputs executed by the toy are very limited, single transmitting and receiving circuits can be utilized to effectively control the toy. In these toys the presence of a signal can be utilized to control one function, and the absence of a signal a further function.

In order to achieve more sophistication in radio controlled toys, one of the expedience resorted to has been the use of multi-channel receivers. While additional control functions can be achieved utilizing a multi-channel receiver, the complexity, and therefore the expense, of the toy also increases. While very sophisticated electronic circuitry may be economically justified for certain industrial remote control operations, the expense of this circuitry precludes its use in toys which must be economically available to the consumer.

With the onset of the robot age, toy robots whose actions are limited simply to stopping and starting, and possibly turning right or left, simply do not fit the preconceived criteria of actions attributable to robots that the child has been exposed to in the movies and the like. In order for a "toy robot" to be something more than a radio controlled car in a stylized housing, the "toy robot" must be able to execute a variety of outputs.

Heretofore, radio controlled toys which were programmable so as to execute a preconceived program, have not been available. The known radio controlled toys operated only in direct response to output of their transmitters. Because of this, any semblance of "independent operation" has been totally lacking from these prior known radio controlled toys.

BRIEF DESCRIPTION OF THE INVENTION

In view of the above, it is a broad object of this invention to provide a remote controlled toy which is capable of executing a variety of outputs, yet can still be controlled by fairly simple and economic transmitting and receiving circuits. It is a further object of this invention to provide for a remote controlled toy which is capable of being programmed so as to be able to execute a variety of outputs in a seemingly independent manner. Additionally, it is an object of this invention to provide a remote controlled toy which because of its engineering principles incorporated therein, is capable of both executing multiple outputs and being programmed, yet is simple enough in construction and operation so as to be economically manufactured, and therefore widely available to the consumer for use and enjoyment.

These and other objects, as will become evident below, are achieved in a radio controlled toy which comprises: a main module; a remote module; a transmitter located on said remote module, said transmitter for transmitting signals; a plurality of function switches located on said remote module, said function switches capable of being activated both singularly and in combinations of at least two of said function switches; a function signal generating means located on said remote housing, said functional signal generating means operatively connected to said plurality of function switches, said function signal generating means for generating function signals in response to activation of said function switches, each of said function signals of a frequency individually characteristic of the activation of a single function switch or a particular combination of said function switches; said function signal generating means further operatively associated with said transmitter, said individual function signals propagated from said function signal generating means to said transmitter whereby said transmitter transmits an output signal characteristic of the particular function signal indicative of which of said switch or combination of switches on said remote housing was activated; a plurality of output function devices located on said main housing, each of said output function devices capable of producing an output, each of said output function devices corresponding to one of said function switches on said remote housing; a receiver located on said main module, said receiver for receiving the output signals transmitted by said transmitter and in response to receipt of said signals said receiver outputting signals of characteristic frequencies corresponding to the respective signals it receives; a control signal generating means located on said main housing in operative association with said receiver so as to receive said signals outputted by said receiver, said control signal generating means further operatively associated with each of said output function devices located on said main housing, said control signal generating means outputting a control signal or combinations of control signals to a respective output function device or combination of output function devices in response to receipt of a signal of a particular frequency from said receiver indicative of activation of a switch or combination of switches whereby said function output device or devices ae activated in response to activation of the respective corresponding function switch or combination of switches.

Further, these objects are achieved in a radio controlled toy which comprises: a main module; a remote module; a transmitter located on said remote module, said transmitter for transmitting signals; a plurality of function switches located on said remote module, said function switches capable of being activated both singularly and in combinations of at least two of said function switches; a function signal generating means located on said remote housing, said function signal generating means operatively connected to said plurality of function switches, said function signal generating means for generating function signals in response to activation of said function switches, each of said function signals individually characteristic of the activation of a single function switch or a particular combination of said function switches; said function signal generating means further operatively associated with said transmitter, said individual function signals propagated from said function signal generating means to said transmitter whereby said transmitter transmits an output signal characteristic of the particular function signal indicative of which of said switch or combination of switches on said remote housing was activated; a plurality of output function devices located on said main housing, each of said output function devices capable of producing an output, each of said output function devices corresponding to one of said function switches on said remote housing; a receiver located on said main module, said receiver for receiving the output signals transmitted by said transmitter and in response to receipt of said signals said receiver outputting signals of characteristic frequencies corresponding to the respective signals it receives; a control signal generating means located on said main housing in operative association with said receiver so as to receive said signals outputted by said receiver, said control signal generating means further operatively associated with each of said output function device located on said main housing, said control signal generating means outputting a control signal or combinations of control signals to a respective output function device or combination of output function devices in response to receipt of a signal from said receiver indicative of activation of a switch or combination of switches whereby said function output device or devices are activated in response to activation of the respective corresponding function switch or combination of switches; a tape recorder located on said main housing, said tape recorder operatively associated with both said receiver and said control signal generating means; one of said function switches on said remote module comprising a control switch for starting and stopping said tape recorder; said tape recorder receiving signals from said receiver and recording said signal, said tape recorder playing back said recorded signals to said control signal generating means so as to activate said output function devices in response to recorded signals.

Additionally, further objects of this invention are achieved by incorporating within the toy robot the capability of acting as a walkie-talkie type toy, such such that the child utilizing the toy can broadcast his or her voice. In the illustrative embodiment this is conveniently achieved by activating one of the function switches on the transmitter to broadcast a signal whereby an audio output circuit on the main module is activated to broadcast any audio signals input to a microphone on the transmitter. Further, in the illustrative embodiment, an additional microphone can be connected to the main housing so as to provide for a second input port for introduction of an audio signal for broadcast by the main housing.

In the illustrative embodiment a timing device is incorporated into the circuitry of the toy allowing for playback of a recorded program of outputs at a time set in the timing device. This is easily achieved by utilizing an alarm function of the timing device to activate the recorder of the toy.

By utilizing a tone encoder capable of generating a variety of frequencies, activation of both single function switches and particular combinations of function switches, can be transmitted by the transmitter to the receiver and the circuitry associated therewith, allowing the remote controlled toy of the invention to either output a single of its output function devices or to output, simultaneously, combinations of the output function devices. In this manner, simultaneous activation of multiples of the output function devices can be achieved utilizing only a minimum of electronic circuitry which allows for economic manufacture of the remote controlled toy of the invention.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the toy electronic arts will realize that these principles and/or concepts are capable of being utilized in a variety of embodiments which may differ from the exact embodiment utilized for illustrative purposes herein. For this reason this invention is not be be construed as being limited solely to the illustrative embodiment, but is only to be construed in view of the claims.

DETAILED DESCRIPTION OF THE INVENTION

Figure 1:
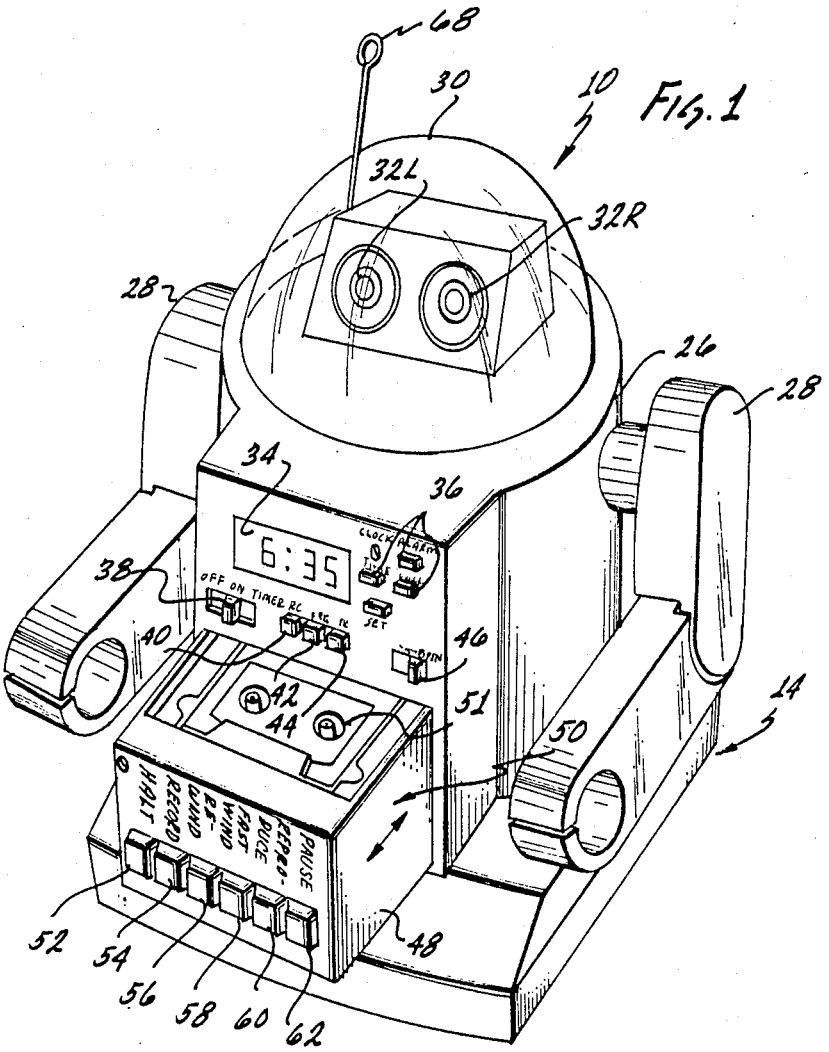
FIG. 1 is an isometric view of the main module of the remote controlled toy of the invention.
Figure 3:
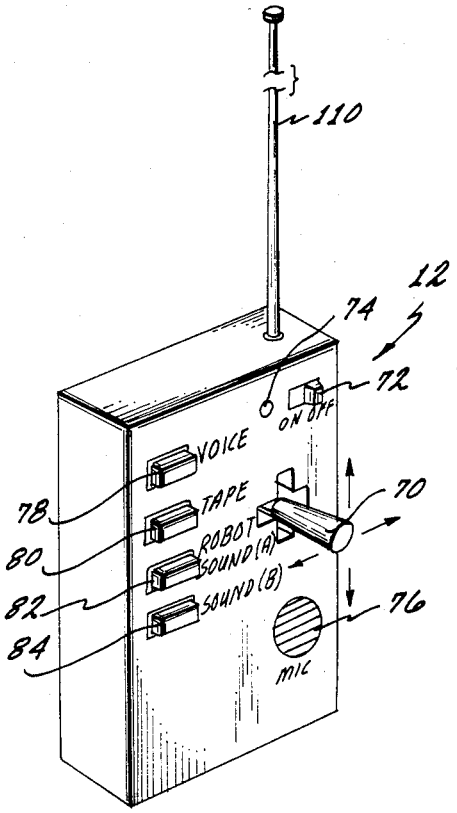
FIG. 3 is an isometric view of the remote module of the remote controlled toy of the invention.
Figure 2:
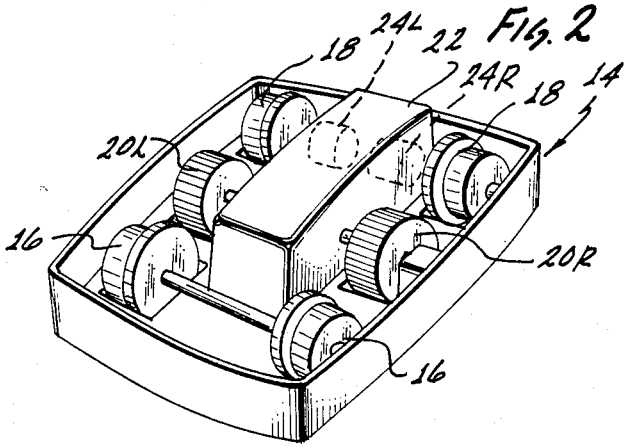
FIG. 2 is an isometric view of the lower portion of the module shown in FIG. 1 with the upper structure removed for clarity of internal components.

The remote controlled toy of the invention has a main module 10 as shown in FIG. 1, and a remote module 12 as shown in FIG. 3. The main module 10 is shaped as a robot. The main module 10 is supported on a bottom housing 14 seen in FIG. 2. Within the bottom housing 14 is a set of front wheels collectively identified by the numeral 16, and a set of back wheels collectively identified by the numeral 18, and a set of middle wheels 20L and 20R. The middle wheels 20L and 20R are independently mounted to a motor case 22 carried on the bottom housing 14. Located within the motor case 22 is a left motor 24L and a right motor 24R.

The motors 24L and 24R are connected to the wheels 20L and 20R by appropriate gears (not separately numbered or shown) allowing for the left middle wheel 20L to be driven by the left motor 24L independently of movement of the right wheel 20R by the motor 24R. The motors 24L and 24R are capable of both forward and reverse operation and, consequently, the wheels 20L and 20R are also capable of both forward and rearward rotation. This allows the main module 10 to progress both forward, backward, and to turn both left and right, as will be described below.

An upper housing 26 of the main module 10 mounts to the bottom housing 14. The upper housing 26 includes arms, collectively identified by the numeral 28, which are pivotally mounted to the housing 26, and are capable of being positioned in a variety of orientations on the housing 26. Movement of the arms 28 is manual and is not under control of the remote module 10.

A clear plastic hemispheric bubble 30 fits on the top of the upper housing 26 and covers left and right eyes 32L and 32R. The eyes 32L and 32R are made of light transmitting material such that the light from certain LEDs, hereinafter described, are viewable through the eyes 32 and the transparent cover 30.

An LCD clock face 34 is viewable in the upper front portion of the upper housing 26. To the right of the clock face 34 are clock control buttons collectively identified by the numeral 36. These allow for setting of the time and certain alarm functions of a clock mechanism carried by the main module 10.

Below and to the left of the clock face 34 is the main control switch 38. The main control switch 38 has an off position, an on position, a timer position. Exact operations of these particular functions will be described below.

To the left of the main control switch 38 are three (3) mode control switches, remote control mode switch 40, programming mode control switch 42, and tape mode control switch 44. By depressing the appropriate control switch 40, 42, or 44, inwardly, the main module 10 is set to operate in either a remote control, a program, or a tape mode. Depression of one of the switches 40, 42, or 44, releases any of the other switches, 40, 42, or 44, thus allowing for easy switching between the modes.

To the right of the mode switches 40, 42, and 44, is a tape cassette release button 46. When this button is moved to the right, it allows for movement of a cassette housing 48 outwardly from a retracted position within the upper housing 26 of the main module 10 to an extended position as is illustrated in FIG. 1. When in the extended position, a tape cassette 51 can be loaded or unloaded from the tape recorder 50 carried in the cassette housing 48. The tape cassette 51 is a standard tape cassette normally usable in any cassette type tape recorder for recording and playback of audio.

On the front of the cassette housing 48 are appropriate tape recorder control buttons as are standard for common tape recorders. They include a stop/eject button 52, a record button 54, a rewind button 56, a fast forward button 58, a play button 60, and a pause button 62. Operation of the tape recorder 50 is standard. Further, the electronics of the tape recorder 50 is also standard with the exception that, as hereinafter explained, certain signals are introduced into a mixing circuit which is inserted between a pre amp and a main amp of the tape recorder 50.

Located just below cassette housing 48 but not seen in FIG. 1, is a speaker 64 which, among other things, is utilized for output of audio from the tape recorder 50. Also located on the main module 10 below the cassette housing 48 is a piezoelectric speaker 66 which is utilized to output certain robot sounds which are outputted under control of the operator via the remote module 12. Additionally, a microphone (not separately numbered) is also located here. The main module 10 further includes a receiving antenna 68, the top of which can be seen in FIG. 1, located behind and extending above the transparent cover 30.

In FIG. 3 the remote module is shown. It includes a joystick 70 which is utilized to activate movement of the main module 10 forward, backward, to the left and to the right by appropriate manipulation of the joystick 70 in the direction desired. Located directly above the joystick 70 is a remote module off/on switch 72 utilized to activate the remote module 12. To the left of the switch 72 is an indicator LED 74, indicating the position of the off/on switch 72. Below the joystick 70 is a pick-up microphone 76 which is utilized for input of the voice of the operator of the toy for broadcasting of the operator's voice through the main speaker 64, as hereinafter described.

Located along the left edge of the remote module 12 are four (4) buttons. The topmost of the buttons, button 78, is depressed when it is desired to broadcast the operator's voice via the pick-up microphone 76. Below the voice button 78 is the remote tape start/stop button 80. This button 80 is utilized to start and stop the tape recorder 50 on the main module 10, as hereinafter explained. Below the tape start/stop button 80 is a robot sound A button 82 which, when depressed, causes the main module 10 to emit a first robot sound via the piezoelectric speaker 66; and below the buttom 82 is a similar robot sound B button 84 which causes the robot to emit a different sound via the piezoelectric speaker 66.

The joystick 70 and the buttons 78, 80, 82, and 84 are connected to certain function switches within the remote module 12 which are utilized to control operation of the main module 10. The joystick interacts with four (4) of these function switches for operation of the main module 10 in a forward direction, a backward direction, to the left and to the right. Each of the buttons 78, 80, 82, and 84 acts as a function switch for broadcasting of the voice of the operator of the toy, start/stop of the cassette tape, and broadcasting of the robot sound A and the robot sound B respectively.

The remote controlled toy of the invention can be operated in a variety of different manners. When the main control switch 38 is in the off position, this totally disables the main module 10. When the remote module off/on switch 72 is in the off position, this totally disables the remote module 12. And, depending upon which of the mode function switches 40, 42, or 44 on the main module 10 is depressed, it might also disable the main module 10.

When the main control switch 38 is placed in the on position, the main module 10 can be operated in either a remote control mode, a program mode, or a tape mode, depending upon which of the particular switches 40, 42, or 44, is depressed. The main module 10 is only responsive in the remote control mode to commands imputed via the remote module 12. When in the program mode, activated by depressing the program mode control switch 42, the main module 10 can either be controlled via the remote module 12 during input of a particular program, or can be controlled via a pre-recorded program either by activation of the tape cassette 51 via the button 80 on the remote module 12, or when the main control switch 38 is in the timer position via activation of an alarm function in the clock. When the main control switch 38 is in the timer position, the main module 10 is no longer responsive to commands inputted by the remote module 12, and is only responsive to commands which have been recorded on an appropriate tape cassette 51.

A tape cassette 51, under control of the tape mode control switch 44, can be utilized in conjunction with the main speaker 64 to play a standard musical cassette tape, or it can be utilized to record music, one's voice, or other appropriate sounds for later playback on either the main module 10 or on any other standard tape cassette playing device.

If one of the robot sounds, A or B, is produced by depressing the appropriate buttons 82 or 84 on the remote module 12 when the main module 10 is in the remote control mode, a pair of LEDs, as hereinafter identified, located behind the eyes 32, flash in conjunction with the beat and tempo of the robot sound. Further, these same LEDs also flash in conjunction with the beat and tempo of any sound which is outputted from the main speaker 64. As such, the eyes 32 flash in response to any sound outputted either from the piezoelectric speaker 66 or the main speaker 64, giving the robot-like shape of the main module 10 somewhat of a personality, in that a visual stimulus is emitted from the main module 10 in conjunction with audio sounds produced by it.

The main module 10 is capable of exhibiting any of its outputs one at a time, or exhibiting, simultaneously, combinations of these outputs. As for instance, the main module 10 can be made to go forward, and then, simultaneously, one of the robot sounds, either sound A or B, can be emitted while the main module 10 is travelling forward. Combinations of the particular functions are possible for all functions with the exception of the broadcasts of sounds inputted to the pick-up microphone 76 on the remote module 12. When the voice button 78 is depressed, a particular signal is broadcast from the remote module 12 to the main module 10 which only enables broadcasting from the main speaker 64 on the main module 10 of any audio inputted into the pick-up microphone 76 on the remote module 12. If the main module 10 is executing movement, whether it be forward, backward, right, or left, and the voice button 78 is depressed, any movement of the main module 10 will cease until such time as the voice button 78 is released.

Figure 6:
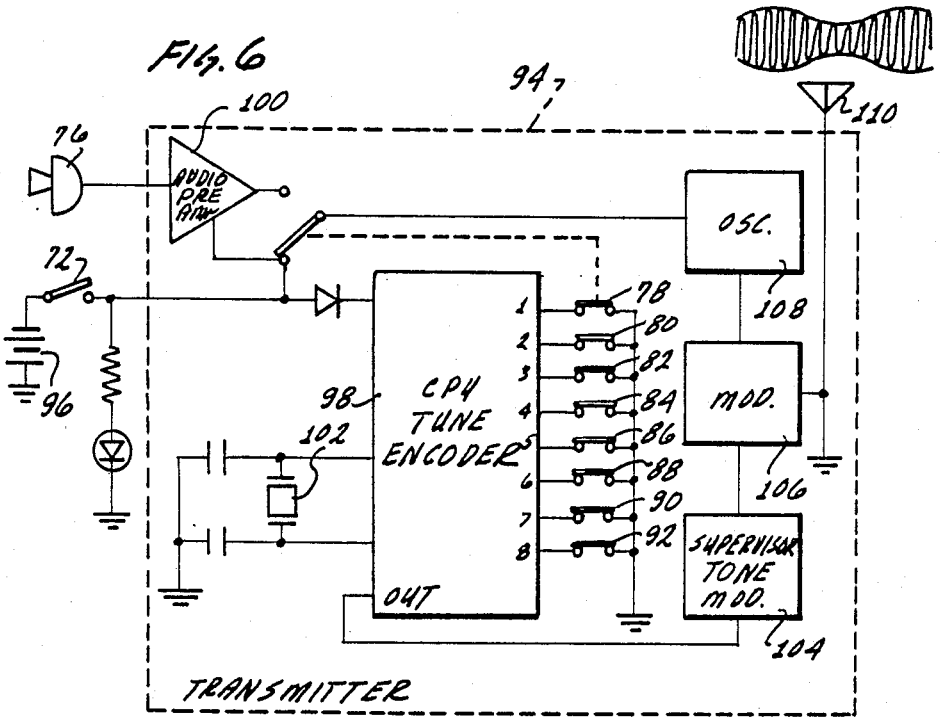
FIG. 6 is a block diagram of the transmitter of the remote controlled toy of the invention.

Referring now to FIG. 6, located within the remote module 12 is a transmitter 94. The transmitter 94 is connected to a power supply 96 via the off/on switch 72. The joystick 70 is connected to switches 86, 88, 90, and 92 within the transmitter 94 which control the forward, reverse, left, and right motions respectively. Within the transmitter 94 is a CPU 98, which serves as a signal encoder within the transmitter 94. Suitable for use as the device 98 is an M6411B-11 manufactured by OKI Electronics Limited, Japan. The voice control switch 78 simultaneously serves as a first input switch to the CPU 98, as well as a switch to connect and disconnect an audio pre amp 100 to other circuitry within the transmitter 94. The audio pre amp 100 is connected to the pick-up mic 76 to receive audio signals from it. The tape start/stop button 80 serves as a second input switch to the CPU 98, with the sound buttons 82 and 84 serving as third and fourth input switches to this CPU. The forward, reverse, left, and right switches, 86, 88, 90, and 92, connected to the joystick 70, serve as remaining input switches to the CPU 98. An appropriate high density ceramic capacitor 102 serves as a timing device for the CPU 98.

The output from the CPU 98 is fed to a supervisory tone modulator 104. It, in turn, is connected to modulator 106, which receives a signal from oscillator 108. Output from the modulator 106 is to transmitting antenna 110, which is utilized to transmit signal to the receiver antenna 68. With the exception of the inclusion of the CPU 98, the transmitter 94 is of standard construction, as is the pre amp 100.

As noted previously, one or more of the control functions on the remote module 12 can be activated at any one time. Depending upon which of these control devices is activated, the switches 78 through 92, connected to the input ports of the CPU 98, are closed. In response to closure of a switch, or a combination of switches, the CPU 98 is programmed so as to output signal of a frequency as is shown in Table I.

TABLE I

| Input Ports of Transmitter CPU 98 | | | | | | | | | Output Ports of Receiver CPU 122 | | | | | | | |
|---|---|---|---|---|---|---|---|---|---|---|---|---|---|---|---|---|
| 1 | 2 | 3 | 4 | 5 | 6 | 7 | 8 | | 1 | 2 | 3 | 4 | 5 | 6 | 7 | 8 |
| FORWARD | RIGHT TURN | REVERSE | LEFT TURN | VOICE ON/OFF | TAPE | SOUND A | SOUND B | Frequency (Hz) | LEFT MOTOR | | RIGHT MOTOR | | VOICE ON/OFF | TAPE | SOUND A | SOUND B |
| 0 | 0 | 0 | 0 | 1 | 0 | 0 | 0 | 1400 | 0 | 0 | 0 | 0 | 1 | 0 | 0 | 0 |
| 1 | 0 | 0 | 0 | 0 | 0 | 0 | 0 | 1600 | 1 | 0 | 1 | 0 | 0 | 0 | 0 | 0 |
| 0 | 1 | 0 | 0 | 0 | 0 | 0 | 0 | 1800 | 1 | 0 | 0 | 1 | 0 | 0 | 0 | 0 |
| 0 | 0 | 1 | 0 | 0 | 0 | 0 | 0 | 2000 | 0 | 1 | 0 | 1 | 0 | 0 | 0 | 0 |
| 0 | 0 | 0 | 1 | 0 | 0 | 0 | 0 | 2200 | 0 | 1 | 1 | 0 | 0 | 0 | 0 | 0 |
| 0 | 0 | 0 | 0 | 0 | 1 | 0 | 0 | 2400 | 0 | 0 | 0 | 0 | 0 | 1 | 0 | 0 |
| 0 | 0 | 0 | 0 | 0 | 0 | 1 | 0 | 2600 | 0 | 0 | 0 | 0 | 0 | 0 | 1 | 0 |
| 0 | 0 | 0 | 0 | 0 | 0 | 0 | 1 | 2800 | 0 | 0 | 0 | 0 | 0 | 0 | 0 | 1 |
| 1 | 0 | 0 | 0 | 0 | 1 | 0 | 0 | 3000 | 1 | 0 | 1 | 0 | 0 | 1 | 0 | 0 |
| 1 | 0 | 0 | 0 | 0 | 0 | 1 | 0 | 3200 | 1 | 0 | 1 | 0 | 0 | 0 | 1 | 0 |
| 1 | 0 | 0 | 0 | 0 | 0 | 0 | 1 | 3400 | 1 | 0 | 1 | 0 | 0 | 0 | 0 | 1 |
| 0 | 0 | 1 | 0 | 0 | 1 | 0 | 0 | 3600 | 0 | 1 | 0 | 1 | 0 | 1 | 0 | 0 |
| 0 | 0 | 1 | 0 | 0 | 0 | 1 | 0 | 3800 | 0 | 1 | 0 | 1 | 0 | 0 | 1 | 0 |
| 0 | 0 | 1 | 0 | 0 | 0 | 0 | 1 | 4000 | 0 | 1 | 0 | 1 | 0 | 0 | 0 | 1 |
| 0 | 1 | 0 | 0 | 0 | 1 | 0 | 0 | 4200 | 1 | 0 | 0 | 1 | 0 | 1 | 0 | 0 |
| 0 | 0 | 0 | 1 | 0 | 1 | 0 | 0 | 4400 | 0 | 1 | 1 | 0 | 0 | 0 | 0 | 0 |
| 0 | 0 | 0 | 0 | 1 | 0 | 0 | 0 | 4600 | 0 | 0 | 0 | 0 | 1 | 0 | 0 | 0 |

As for instance, if robot sound A, switch 82, is depressed, the CPU 98 outputs a tone frequency of 2600 Hz. If, however, this same switch 82 is depressed simultaneously with movement of the joystick 70 such that the forward switch 86 is closed, the CPU 98 outputs a control signal of 3000 Hz. When the voice switch 78 is closed, the audio pre amp 100 is connected to the oscillator 108 simultaneously with closing of the switch 78 connected to an input port of the CPU 98. The CPU 98 outputs a signal of 1400 Hz. Upon release of the voice button 78, the audio pre amp 100 is disconnected from the oscillator 108, and the switch 78 connected to the input port of the CPU 98 is released to the off position, resulting in the CPU 98 outputting a signal of 4600 Hz. With use of the CPU device 98 noted above, it is evident that a variety of single commands, as well as combinations of commands, can be transmitted from the remote module 12 to the main module 10 for execution of a single output or simultaneous execution of multiple outputs.

The oscillator 108 of the transmitter 94 utilizes a crystal, as for instance, a 49.860 MHz crystal, to produce a carrier signal as is indicated above the antenna 110 in FIG. 6, which is encoded with a signal of a particular frequency determined by which switch, or multiple of switches, connected to the input ports of the CPU 98 are closed, so as to encode a supervisory signal onto the transmitting signal. By utilizing a standard AM transmitter for the transmitter 94, an AM signal having the control frequency encoded thereon, is easily and conveniently achieved.

Figure 5:
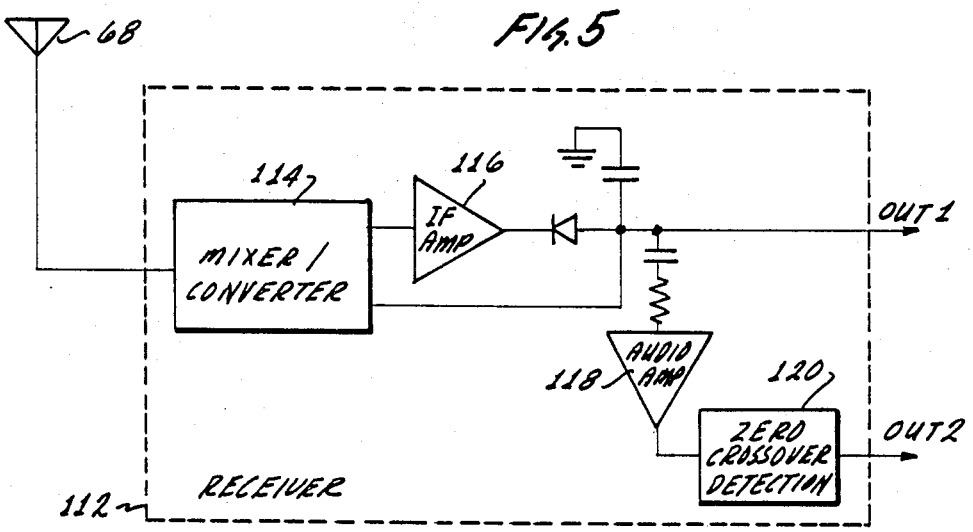
FIG. 5 is a block diagram of the receiver of the remote controlled toy of the invention.

A receiver 112, matched to the transmitter 94, is located in the main module 10. The receiver 112 is also standard, as for instance a super heterodyne receiver. As shown in FIG. 5, it includes a mixer/converter 114 which feeds an IF amp 116. An appropriate crystal, as for instance a 49.405 MHz crystal, would be utilized in the mixer/converter so as to achieve a 455 KHz standard IF frequency from the IF amp.

The audio signal from the pick-up microphone 76, introduced through the transistor pre amp 100, is removed at a first output port from the receiver as a first output. The receiver further includes an audio amplifier 118 which inputs to a zero crossover detector 120 which is connected to a second output port to output a second output. The second output signal corresponds in frequency to the frequency outputted by the CPU 98.

Within the main module 10, there is a further CPU, CPU 122, which is also an OKI M6411.B-11 which serves as a decoder of the frequency signals outputted at output port 2 of the receiver 112. As will be hereinafter explained with reference to FIGS. 4 and 7, the signals outputted from output port 2 of the receiver 112 are inputted into CPU 122 and, in response thereto, depending upon the particular frequency of the signal, signal is present at the output ports of the CPU 122, either singularly or in combination, corresponding to the input to the CPU 98 of the transmitter 94. This is summarized in Table I.

Output ports 1 and 2 of CPU 122 feed motor controller 124 which is connected to motor 24L. Output ports 3 and 4 of CPU 122 feed motor controller 126 which is connected to motor 24R. Used as motor controllers 124 and 126 are LB 1645's manufactured by Sanyo Electric Co., Tokyo, Japan. The LB 1645's are motor controllers capable of controlling motors in both a forward and reverse direction depending upon input to one or another ports of these motor controllers.

Signal present at output of port 1 of CPU 122 controls forward rotation of motor 24L, and likewise, signal at output of port 3 of CPU 122 controls forward rotation of motor 24R. Signal at output at port 2 of CPU 122 controls reverse rotation of motor 24L, and signal at output at port 4 of CPU 122 controls reverse rotation of motor 24R.

As such, forward motion of the main module 10 is achieved by simultaneous signal output at ports 1 and 3 of CPU 122, and reverse motion of main module 10 results in simultaneous signal at ports 2 and 4 of CPU 122. A right hand turn is accomplished via simultaneous signal at ports 1 and 4, and a left hand turn is accomplished with simultaneous signal at ports 2 and 3 of CPU 122. As is evident from Table I, outputs at the particular ports of the transmitter CPU 98 result in transmission of a control signal of a particular frequency which is then decoded by the receiver CPU 122 which then outputs a signal at its respective output ports to control the main module 10.

The clock face 34 and the clock control button 36 are connected to an LSI device 128 which is a timing device. Suitable as the LSI timing device 128 is an MSM 6502, also manufactured by OKI Electronics Co., Ltd. Output ports 6, 7, and 8 of the receiver CPU 122 are also connected to the LSI timer 128. Port 6 serves to control the remote starting and stopping of the cassette tape recorder, and ports 7 and 8 respectively serve to control robot sounds A and B.

In response to activation of the voice button 78 on the remote module 10, as is noted in Table I, a 1400 Hz signal is encoded onto the signal transmitted by the transmitter 94 and received by the receiver 112. The receiver removes the code signal from the carrier signal and feeds it to the receiver CPU 122. This signal is then outputted at port 5 of the CPU 122 which feeds a signal to both an amplifier 130 and to a further device, as hereinafter explained. The amplifier 130 controls a relay 132 which, when closed, completes a first circuit to the main speaker 64.

As noted above, the receiver CPU 122 serves as a control signal generating means for propagating appropriate control signals to output function devices, i.e. motors 24L, 24R, speaker 64, amp 130, and relay 132, as well as the functions associated with the timing device 128. The circuitry on the main module 10 includes a switching circuit 134 which serves as a main module circuit control means. Output from first output port of receiver 112 is fed to the switching circuit 134 as are several other outputs discussed in detail with reference to FIG. 7 below. Output from second output port of the receiver 112 is fed either directly via gate circuit 136 to the input of the CPU 122, or indirectly through the program mode control switch 42 to the gate circuit 136 and to the input port of the CPU 122.

Figure 4:
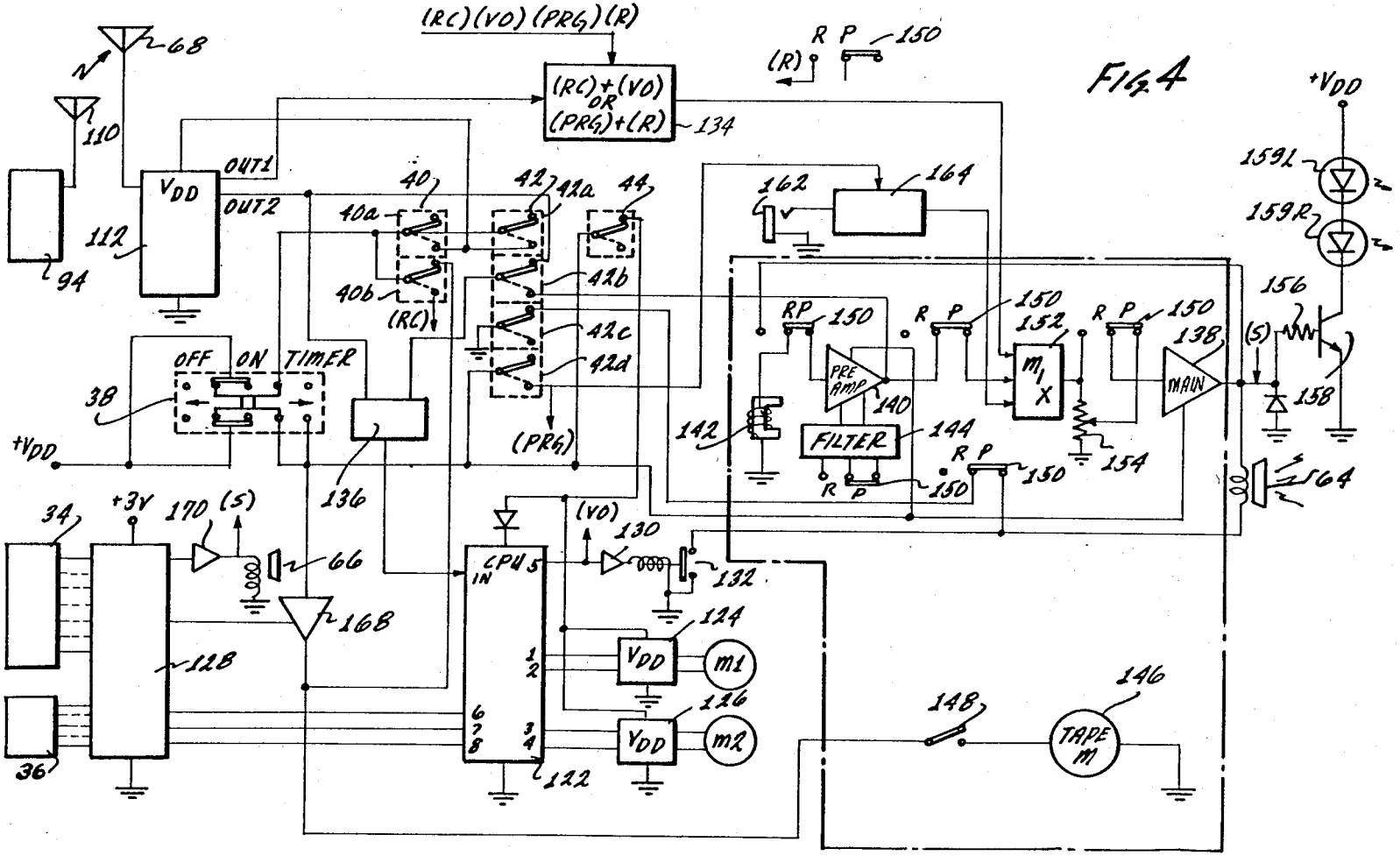
FIG. 4 is a block diagram of the remote controlled toy of the invention.

The tape recorder 50 includes a main amplifier 138, a pre amp 140, a recording head 142, a pre amp filter 144, a tape drive motor 146, a tape motor control switch 148, as well as a recording slide switch 150 which is a multiple contact switch with its individual switching elements shown in appropriate places throughout the circuitry of FIG. 4.

Interspaced between the pre amp 140 and the main amp 138 of the tape recorder 50 is a mixing circuit 152. Output from the mixing circuit 152 is fed either in the recording mode through recording switch 150 to the main amp 138, or in the non-recording mode to the main amp 138 through a variable resistor 154 serving as a volume control. When in the non-recording mode, signal picked up from a tape cassette 51 by the recording head 142 is fed through the pre amp to the mixer and to the main amp and outputted to the speaker 64. Simultaneously, signal is also outputted via resistor 156 to the base of a transistor 158 which controls current flow through LEDs, collectively identified by the numeral 159, which are positioned behind the eyes 32 as previously explained. An external microphone 160 is connectable via a jack 162 to a gate 164. The gate 164 is controlled as described in FIG. 7, however, when activated, signal from the microphone 160 is inputted through the mixer 152, and when the recording switch 54 of the tape recorder 50 is put into the recording position and recording switch 150 is slid to the left, signal is propagated through the main amp and to the recording head 142 for recording on an appropriate tape cassette 51.

As hereinafter explained, signal can be propagated through the switching circuit 134 from the first output port of the receiver 112 into the mixing circuit 152, also for input to the main amp 138 for either output through the speaker 64 or for recording onto an appropriate tape cassette 51 through recording head 142. Any signal passed from the receiver 112 through switching circuit 134 can be recorded onto a cassette tape 51, as can audio input through microphone 160 connected to the jack 162.

In response to signal from port 6 of the CPU 122 to the timing device 128, the timing device 128 will output a signal to a current amplifier 168 interspaced between the main control switch 38 and the tape motor control switch 148. The tape motor control switch 148 is closed whenever the record, rewind, fast forward, or play buttons of the tape recorder 50 are depressed.

If a signal is outputted at ports 7 or 8 of the CPU 122 to the timing device 128, the timing device 128 outputs a signal to amplifier 170 which drives piezoelectric speaker 66, as well as inputs a signal to the resistor 156 and the transistor 158 to control the LEDs 159 behind the eyes 32. Depending upon which output port 7 or 8 of the CPU 122 goes high, one of two stored programs within the timing device 128 is outputted to the amplifier 170. Because of this, two distinct robot sounds, sounds A and B, can be outputted from the piezoelectric speaker 66.

Having now identified all of the components of FIG. 4, operation of the different modes will be described. When the main control switch 38 is switched to the on position, and the remote control switch 40 is depressed, this positions the switching elements of the remote control switch 40 in the position shown in phantom line in FIG. 4. A supply voltage current is completed to the receiver 112 via switching element 40A, and a further supply voltage circuit is completed to the switching circuit 134 via the switch element 40B. Concurrently, the program switch 42 and the tape switch 44 are in the positions shown in solid line in FIG. 4 such that output from the second output port of the receiver 112 can pass through switch element 42B to the gate circuit 136 and to the input port of the CPU 122.

Upon receipt of signal at its input port, the CPU 122 then outputs an appropriate signal to its appropriate output port depending upon the frequency of the signal inputted. As noted above, this can be output to a single output port, or outputs to a combination of output ports, depending upon the frequency of the signal.

If use of the buttons of the cassette recorder 50 that closes switch 148 is depressed, any direct circuit through switch element 40B is broken when the remote control switch is activated. However, when a tape turn on signal is outputted from port 6 of the CPU 122 to the timing device 128, the timing device 128 turns on the current amplifier 168 to complete a circuit of the tape motor 146 to activate the tape motor 146 such that any audio on the cassette tape 51 is played out through the speaker 64. However, when program switch element 42B is in the position shown in solid line in FIG. 4, no control signals on the tape can be propagated through the gate circuit 136 to the intput port of the CPU 122. Turning the tape on and off while in the remote control mode is utilized to start the tape recorder for broadcasting of a pre-recorded musical, or voice recording, on the tape cassette 51.

If, while in the remote control mode (that is when the remote control switch 40 is in the position shown in phantom line in FIG. 4), the voice button 78 is activated, output port 5 of the CPU 122 goes high and a signal, hereinafter referred to as voice signal VO, is propagated to the switching circuit 134. Also when this happens, the remainder of the ports, port 1, 2, 3, 4, 6, 7, and 8 of the CPU 122 are fixed low, and the relay 132 is closed. As hereinafter explained, upon simultaneous receipt of both a remote control signal from switch element 40B and a VO signal from output port 5 of the CPU, the switching circuit 134 propagates a signal from the first output port of the receiver 112 to the mixing circuit 152 for passage of that signal through main amp 138 and broadcasting through the speaker 64. This is only done, however, upon concurrent receipt of both the remote control signal, i.e. an RC signal from element 40B, and the VO signal from output 5 of the CPU 122. If one or the other of the RC and VO signals is not present, output from output 1 of the receiver 112 is not propagated to the mixing circuit 152. Upon release of the voice button 78, a new 4600 Hz signal is propagated to the CPU 122. This causes output port 5 of the CPU 122 to go low, and thus severs the VO signal to the switching circuit 134. With loss of the VO signal, the switching circuit 134 no longer allows propagation of the signal to the mixing circuit 152 and, simultaneously, the remaining ports of the CPU 122 are reset so they can go high upon receipt of an appropriate signal.

If the main switch 38 is positioned in either the off position or the timer position, source voltage is no longer supplied to the remote control switch 40, and the toy will no longer operator. The remote control mode is only utilized when the main switch is in the on position and is utilized in conjunction with signals broadcast from the remote module 12 or inputted through a microphone 160 connected to the jack 162.

When the tape button 44 is activated and is positioned in a position shown in phantom line in FIG. 4, source voltage to the CPU 122 is severed, and thus the main module 10 is no longer responsive to any signals outputted from the remote module 12 or stored on a tape cassette 51 which might be played in the tape recorder 50. The tape recorder 50, however, will output through the speaker 64 any audio information on a tape cassette 51 which is played on the tape recorder 50. Additionally, as hereinafter explained, when no source voltage is supplied to the gate 164, input from a microphone 160 through the jack 162 to the mixing circuit 152 is possible, and as such, any input audio to the microphone 160 can be recorded on the tape cassette 51.

When the programming switch 42 is depressed, it is positioned as shown in phantom line in FIG. 4. When the main switch 38 is in the on position, source voltage is supplied via switching element 42A to the receiver 112, activating the same. The circuit via the switching element 42B to the gate circuit 136 is broken, and thus, signal cannot be propogated through this switching element to the input port of the CPU 122. As hereinafter explained, if the record button of the tape recorder 50 is in the record position, signal will be propagated through the gate circuit 136 to the input port of the CPU 122 such that the signal can be recorded on a tape cassette 51 located in the tape recorder 50.

When the switching element 42B is activated, as shown in the phantom line position of FIG. 4, a signal, i.e. a PRG signal, is propagated to the switching circuit 134, and, as hereinafter explained, if, concurrently, a signal, i.e. an R signal, is also propagated via the record switch to switching circuit 134, any signal outputted at the first output port of the receiver 112, is propagated to the mixing circuit 152 for amplification by the main amplifier 138, and recording of the same on a cassette tape via the recording head 142. Concurrently, signal is also propagated to the transistor 158 to activate the LEDs 159.

With positioning of the switching element 42B in the phantom line position, the gate 164 is inactivated, and as such, no audio information can be inputted via a microphone 160 through jack 162 to the mixing circuit 152, and, ultimately, to either the speaker 64 or the recording head 142. An audio signal, however, can be inputted into the pick-up microphone 76 of the remote module 12 in the same manner as explained for the remote control operation.

When both the programming switch 42 is activated, and the recording switch 150 is in the recording position, signals are inputted to the CPU 122 via its input port. The signals are outputted to the appropriate output ports and, simultaneously, they are also recorded on a tape cassette 51. At this time, the operator of the toy can then input a variety of signals through the remote modulus 12 to the main module 10, and concurrently the main module 10 will execute the outputs associated with the signals and will also record the signals on a cassette tape 51.

To replay the signals on a cassette tape 51, the programming switch 42 is depressed, putting the toy in the programming mode. Concurrently, the recording switch must not be in the recording position, but must be in the position as seen in solid line in FIG. 4. The signals will then be picked up off of the cassette tape 51 by the recording head 142 and be passed through the pre amp for feeding through the switching element 42B to the gate circuit 136 for input to the input port of the CPU 122. The main module 10 will then execute the recorded program mimicking each and every output which was programmed into the toy. This includes, of course, audio output which was also stored on the tape cassette 51 during input of the recorded program.

When the main switch 38 is positioned in the timing position as noted previously, all source voltage circuits to the switching elements 40A and 42A are broken, which turns off the receiver 112. Source voltage, however, is supplied to both the pre amp 140 and the main amp 138 of the tape recorder 50.

The timing device 128 can be set to an alarm time by utilizing the clock control buttons 36, as is standard for LSI timing devices. When the main switch 38 is in the timer mode, and the tape recorder 50 is left with the play button 60 depressed such that the switch 148 is closed, an alarm time may be programmed into the timing device 128. Then when the appropriate alarm time is reached, the timing device 128 outputs a signal to the current amplifier 168 turning on the current amplifier 168 so as to complete a circuit between the main switch 38 and the tape motor 146. At this time the tape recorder will be started and the signals stored on a program cassette tape 51 will be picked up by the recording head 142 and fed through the pre amp 140 to the switching element 42B and to the gate circuit 136 for propagation to the input port of the CPU 122. This activates the main module 10, and the program stored on the tape cassette 51 will be executed starting at the appropriate time stored in the alarm function of the timing device 128.

It is evident that the toy can be first programmed and then set to go off at a particular time in the future utilizing the alarm function in the timing device 128 to control the starting of the tape motor 146.

Figure 7:
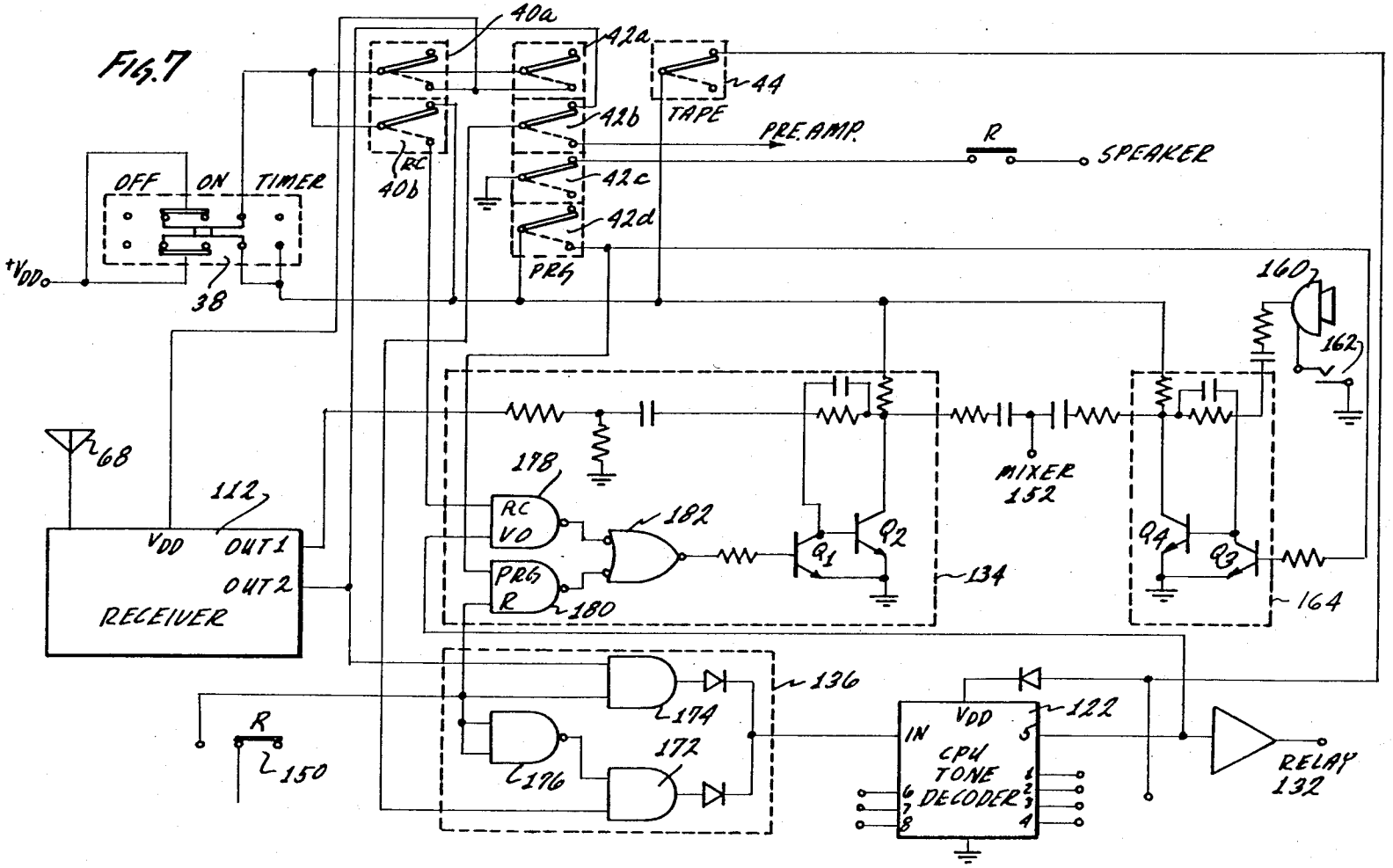
FIG. 7 is a schematic of certain portions of FIG. 4.

FIG. 7 shows the schematic for the switching circuit 134, the gate circuit 136, and the gate 164. The gate circuit 136 includes two (2) AND gates 172 and 174. The output of these two AND gates is fed to the input port of the CPU 122. One of the inputs of AND gate 174 is connected to the recording slide switch 150. When the recording slide switch 150 is closed upon depression of the record button 54 of the tape recorder 50, this input of the gate 174 goes high. Simultaneously, a signal is also fed to both inputs of a NAND gate 176, whose output is connected to one of the inputs of AND gate 172. When the recording switch 150 is activated, the signal from NAND gate 176 to AND gate 172 goes low, and when the recording switch 150 is inactivated, the signal to AND gate 172 from NAND gate 176 goes high.

When the remote control switch 40 is depressed, its position, as discussed above, is shown in phantom lines in FIG. 7, as it was in FIG. 4. At this time, the position of the switch element 42B of the program switch shown in solid line in FIG. 7 is such that a circuit is completed from the second output port of the receiver 112 through the switching element 42B to the other input of the AND gate 172. Thus, when the recording switch 150 is not in the recording mode, the AND gate 172 is high at both of its inputs and, therefore, propagates the signal from the second output port of the receiver 112 to the input port of the CPU 122. When the recording switch 150, however, is in the record mode, the output of the AND gate 172 goes low, and, as such, one of the inputs to the AND gate 172 goes low such that no signal is propagated to the CPU 122.

When the program switch 42 is depressed, the input to the AND gate 172 is severed via the switching element 42B. However, one of the inputs to the AND gate 174 is directly connected to the second output port of the receiver 112. If the recording switch 150 is not activated, the other input to the AND gate 174 is low and, as such, no signal is passed through the AND gate 174 to the input of the CPU 122. If, however, the recording switch 150 is activated, the AND gate 174 goes high at both of its inputs, and, therefore, propagates the input from the second output port of the receiver 112 to the input port of the CPU 122.

The CPU 122, therefore, receives an input signal from the second output port of the receiver 112 whenever both the recording switch 150 and the programming switch 42 are inactivated, or whenever the recording switch 150 is activated. A program, however, cannot be recorded when the remote control mode switch 40 is activated, and the recording switch 150 is also activated, because signal will not be propagated through the open switching element 42B to the mixing circuit 152.

Referring now to the switching circuit 134, as noted above, when both the remote control button 40 is activated (the RC signal) and a voice actuated signal (the VO signal) is received from the output 5 of the CPU 122, the switching circuit 134 is switched on allowing propagation of the audio signal from the first output port of the receiver 112 to the mixing circuit 152. Also, when both the program mode switch 42 is activated (the PRG signal) and the recording switch 150 is activated (the R signal), the switching circuit 134 is also switched on to allow passage of signal from the first output port of the receiver 112 to the mixing circuit 152.

The switching circuit 134 operates as follows. The outputs from two (2) NAND gates 178 and 180 feed gate 182 which is equivalent to an AND gate. The output of gate 182, in turn, is connected to the base of transistor Q1. Switching element 40B of the RC control switch 40 is connected to one of the inputs of gate 178 and the other input of gate 178 is connected to output 5 of the CPU 122. Switching element 42D of the program mode switch 42 is connected to one of the inputs of gate 180, and the other input is connected to the record switch 150.

The logic of the gates 178, 180, and 182 is such that whenever both of the inputs to either gate 178 or 180 is high, the output of gate 182 is low. Whenever both of the inputs to either gates 178 and 180, or one of the inputs to either gates 178 or 180, is low, the output of gate 182 is high. Therefore, in order to have the output of gate 182 be low, either simultaneous input of both the RC signal and the VO signal must be inputted to gate 178, or simultaneous input of the PRG signal and R signal must be inputted to gate 180.

Signal from the first output port of receiver 112, after passing through a DC blocking capacitor, feeds the junction point wherein the collector of Q1 connects to an RC circuit. When the output from gate 182 is high, Q1 is high, and shunts any signal to ground. When the output from gate 182 is low, Q1 also is low. The collector of Q1 is connected to the base of transistor Q2. When Q1 is low, Q2 is no longer shunted, and signal from first output of receiver 112 can pass through an RC circuit (a post detection filter) to Q2 (an audio amp), to the mixer 152.

Input from the microphone 160 is controlled in a similar way. The gate 164 includes a control transistor Q3 whose base is connected to switching element 42D. The base of Q3 is high whenever the program switch 42 is activated. When the base of Q3 is high, Q3 essentially serves as a shunt for any audio signal inputted to the microphone 160, feeding this signal to ground. When the program mode switch 42 is not activated, and is in the position as seen in solid line in FIG. 7, the base of Q3 is low.

The collector of Q3 is connected to the base of transistor Q4. Signal from the microphone 160 is fed to the base of Q4 and through the RC circuit associated with it. When Q3 is low, this signal is fed by Q4 to the mixing circuit 152. Audio input to the microphone 160 is fed to the mixing circuit in either the remote control or the tape modes, but is inhibited in the program mode when program switch 42 is depressed, rendering Q3 high.

I claim:

1. A radio controlled toy which comprises:

a main module;

a remote module;

a transmitter located on said remote module, said transmitter for transmitting signals;

a plurality of function switches located on said remote module, said function switches capable of being activated both singularly and in combinations of at least two of said function switches;

a function signal generating means located on said remote housing, said function signal generating means operatively connected to said plurality of function switches, said function signal generating means for generating function signals in response to activation of said function switches, each of said function signals of a single discrete frequency individually characteristic of the activation of a single function switch or a particular combination of said function switches;

said function signal generating means further operatively associated with said transmitter, said individual function signals propagated from said function signal generating means to said transmitter whereby said transmitter transmits a single discrete frequency output signal characteristic of the particular function signal indicative of which of said switch or combination of switches on said remote housing was activated;

a plurality of output function devices located on said main housing, each of said output function devices capable of producing an output, each of said output function devices corresponding to one of said function switches on said remote housing;

a receiver located on said main module, said receiver for receiving the output signals transmitted by said transmitter and in response to receipt of said signals said receiver outputting signals of characteristic frequencies corresponding to the respective signals it receives;

a control signal generating means located on said main housing in operative association with said receiver so as to receive said signals outputted by said receiver, said control signal generating means further operatively associated with each of said output function devices located on said main housing, said control signal generating means outputting a control signal or combinations of control signals to a respective output function device or combination of output function devices in response to receipt of a signal of a single particular frequency from said receiver indicative of activation of a switch or combination of switches whereby said function output device or devices are activated in response to activation of the respective corresponding function switch or combination of switches.

2. The toy of claim 1 wherein:

said main module further includes recording means located thereon, said recording means operatively associated with both of said receiver means and said control signal generating means, said recording means for recording receiver output signals and feeding back said recorded signals to said control signal generating means so as to activate said output function devices in response to a recorded record of the activation of said function switches;

said recording means including further means for storing and then feeding back said recorded signals to said control signal generating means at a time displaced in time from the time of receipt of said signals by said receiver means to activate said output function device or devices associated with signal at said displaced time.

3. The toy of claim 1 wherein:

said transmitter includes audio circuit means and a microphone operatively connected to said audio circuit means to supply an audio signal to said audio circuit means, said transmitter further capable of transmitting an audio signal;

said receiver includes at least one output port;

said main housing further including main module circuit and a speaker connected to said main module circuit, said main module circuit operatively connected to said output port so as to receive a signal corresponding to said audio signal and to broadcast said signal through said speaker.

4. The toy of claim 1 wherein:

said transmitter is an AM transmitter and broadcasts an AM signal having said frequencies corresponding to said activation of said function switches encoded thereon.

5. The toy of claim 2 wherein:

said further means includes a timing means, said timing means operatively associated with said recording means, said timing means capable of controlling the feeding back of said recorded receiver signals to said control signal generating means such that a pattern of receiver output signals can be recorded by said recording means at a first time and can be fed back to said control signal generating means at a second time for activation of said output function devices at said second time.

6. The toy of claim 3 wherein:

one of said plurality of function switches on said remote housing comprises an audio function switch, said audio function switch operatively connected to both said function signal generator means and said transmitter, whereby when said audio function switch is activated said function signal generating means propagates a signal of a particular frequency to said transmitter and connects said audio circuit to said transmitter.

7. The toy of claim 6 wherein:

said main housing includes a first mode control switch having an activated and an inactivated position;

said main housing further including a main module circuit control means operatively associated with said control signal generating means so as to receive a control signal from said control signal generating means in response to activation of said audio function switch;

said main module circuit control means further operatively associated with said first mode control switch so as to receive a signal in response to said first mode control switch being in said activated position;

said main module circuit control means further operatively associated with said main module circuit whereby said main module circuit control means controls propagation of audio signals from said output port to said main module circuit, said main module circuit control means allowing propagation of audio signals from said output port to said main module circuit in response to simultaneous receipt of a signal from said first mode control switch and from said control signal generating means.

8. The toy of claim 7 wherein:

said main module further includes recording means located thereon, said recording means operatively associated with both said receiver means and said control signal generating means, said recording means for recording receiver output signals and feeding back said recorded signals to said control signal generating means so as to activate said output function devices in response to a recorded record of the activation of said function switches.

9. The toy of claim 8 wherein:

said recording means connecting to said receiver through said main module circuit;

said main housing further including a second mode control switch, said second mode control switch having an activated and an inactivated position;

said main module circuit control means operatively connected to said second mode control switch so as to receive a signal from said second mode control switch in response to said second mode control switch being in its activated position;

said recording means including a recording control switch having an activated and an inactivated position;

said main module circuit control means operatively connected to said recording control switch so as to receive a signal from said recording control switch in response to said recording control switch being in its activated position;

said main module circuit control means allowing propagation of receiver output signals from said receiver to said recording means in response to simultaneous receipt by said main module circuit control means of a signal from said second mode control switch and said recording control switch.

10. A radio controlled toy which comprises:

a main module;

a remote module;

a transmitter located on said remote module, said transmitter for transmitting signals;

a plurality of function switches located on said remote module, said function switches capable of being activated both singularly and in combinations of at least two of said function switches;

a function signal generating means located on said remote housing, said function signal generating means operatively connected to said plurality of function switches, said function signal generating means for generating function signals in response to activation of said function switches, each of said function signals of a frequency individually characteristic of the activation of a single function switch or a particular combination of said function switches;

said function signal generating means further operatively associated with said transmitter, said individual function signals propagated from said function signal generating means to said transmitter whereby said transmitter transmits an output signal characteristic of the particular function signal indicative of which of said switch or combination of switches on said remote housing was activated;

a plurality of output function devices located on said main housing, each of said output function devices capable of producing an output, each of said output function devices corresponding to one of said function switches on said remote housing;

a receiver located on said main module, said receiver for receiving the output signals transmitted by said transmitter and in response to receipt of said signals said receiver outputting signals of characteristic frequencies corresponding to the respective signals it receives;

a control signal generating means located on said main housing in operative association with said receiver so as to receive said signals outputted by said receiver, said control signal generating means further operatively associated with each of said output function devices located on said main housing, said control signal generating means outputting a control signal or combinations of control signals to a respective output function device or combination of output function devices in response to receipt of a signal of a particular frequency from said receiver indicative of activation of a switch or combination of switches whereby said function output device or devices are activated in response to activation of the respective corresponding function switch or combination of switches;

said main module further includes recording means located thereon, said recording means operatively associated with both of said receiver means and said control signal generating means, said recording means for recording receiver output signals and feeding back said recorded signals to said control signal generating means so as to activate said output function devices in response to a recorded record of the activation of said function switches;

said recording means include further input means and further output means, said further input means for recording on said recording mens an audio signal, said further output means for outputting said audio signal from said recording means.

11. The toy of claim 10 wherein:

said recording means includes a tape recorder;

one of said function switches on said remote module comprises a control switch for starting and stopping said tape recorder.

12. A radio controlled toy which comprises:

a main module;

a remote module;

a transmitter located on said remote module, said transmitter for transmitting signals;

a plurality of function switches located on said remote module, said function switches capable of being activated both singularly and in combinations of at least two of said function switches;

a function signal generating means located on said remote housing, said function signal generating means operatively connected to said plurality of function switches, said function signal generating means for generating function signals in response to activation of said function switches, each of said function signals of a frequency individually characteristic of the activation of a single function switch or a particular combination of said function switches;

said function signal generating means further operatively associated with said transmitter, said individual function signals propagated from said function signal generating means to said transmitter whereby said transmitter transmits an output signal characteristic of the particular function signal indicative of which of said switch or combination of switches on said remote housing was activated;

a plurality of output function devices located on said main housing, each of said output function devices capable of producing an output, each of said output function devices corresponding to one of said function switches on said remote housing;

a receiver located on said main module, said receiver for receiving the output signals transmitted by said transmitter and in response to receipt of said signals said receiver outputting signals of characteristic frequencies corresponding to the respective signals it receives;

a control signal generating means located on said main housing in operative association with said receiver so as to receive said signals outputted by said receiver, said control signal generating means further operatively associated with each of said output function devices located on said main housing, said control signal generating means outputting a control signal or combinations of control signals to a respective output function device or combination of output function devices in response to receipt of a signal of a particular frequency from said receiver indicative of activation of a switch or combination of switches whereby said function output device or devices are activated in response to activation of the respective corresponding function switch or combination of switches;

said main module further includes recording means located thereon, said recording means operatively associated with both of said receiver means and said control signal generating means, said recording means for recording receiver output signals and feeding back said recorded signals to said control signal generating means so as to activate said output function devices in response to a recorded record of the activation of said function switches;

said main housing further includes a timing means, said timing means operatively associated with said recording means, said timing means capable of controlling the feeding back of said recorded receiver signals to said control signal generating means such that a pattern of receiver output signals can be recorded by said recording means at a first time and can be fed back to said control signal generating means at a second time for activation of said output function devices at said second time;

said recording means includes a tape recorder;

said timing means includes a timing device having an alarm function, said alarm function capable of turning said tape recorder on at a time set in said alarm function so as to output a pattern of receiver output signals to said control signal generating means at said set time.

13. A radio controlled toy which comprises:

a main module;

a remote module;

a transmitter located on said remote module, said transmitter for transmitting signals;

a plurality of function switches located on said remote module, said function switches capable of being activated both singularly and in combinations of at least two of said function switches;

a function signal generating means located on said remote housing, said function signal generating means operatively connected to said plurality of function switches, said function signal generating means for generating function signals in response to activation of said function switches, each of said function signals individually characteristic of the activation of a single function switch or a particular combination of said function switches;

said function signal generating means further operatively associated with said transmitter, said individual function signals propagated from said function signal generating means to said transmitter whereby said transmitter transmits an output signal characteristic of the particular function signal indicative of which of said switch or combination of switches on said remote housing was activated;

a plurality of output function devices located on said main housing, each of said output function devices capable of producing an output, each of said output function devices corresponding to one of said function switches on said remote housing;

a receiver located on said main module, said receiver for receiving the output signals transmitted by said transmitter and in response to receipt of said signals, said receiver outputting signals of characteristic frequencies corresponding to the respective signals it receives;

a control signal generating means located on said main housing in operative association with said receiver so as to receive said signals outputted by said receiver, said control signal generating means further operatively associated with each of said output function devices located on said main housing, said control signal generating means outputting a control signal or combinations of control signals to a respective output function device or combination of output function devices in response to receipt of a signal from said receiver indicative of activation of a switch or combination of switches whereby said function output device or devices are activated in response to activation of the respective corresponding function switch or combination of switches;

a tape recorder located on said main housing, said tape recorder operatively associated with both said receiver and said control signal generating means;

one of said function switches on said remote module comprising a control switch for starting and stopping said tape recorder;

said tape recorder receiving signals from said receiver and recording said signal, said tape recorder playing back said recorded signal to said control signal generating means so as to activate said output function devices in response to recorded signals.

14. The toy of claim 13 wherein:

said transmitter includes audio circuit means and a microphone operatively connected to said auido circuit means to supply an audio signal to said audio circuit means, said transmitter further capable of transmitting an audio signal;

said receiver includes an audio output port;

said main housing further including main module circuit and a speaker connected to said main module circuit, said main module circuit operatively connected to said output port so as to receive a signal corresponding to said audio signal and to broadcast said signal through said speaker.

15. The top of claim 13 wherein:

said main housing further includes a timing means, said timing means operatively associated with said tape recorder, said timing means capable of controlling the feeding back of said recorded receiver signals to said control signal generating means such that a pattern of receiver output signals can be recorded by said tape recorder at a first time and can be fed back to said control signal generating means at a second time for activation of said output function devices at said second time.

16. The toy of claim 15 wherein:

said timing means includes a timing device having an alarm function, said alarm function capable of turning said tape recorder on at a time set in said alarm function so as to output a pattern of receiver output signals to said control signal generating means at said set time.

17. The toy of claim 14 wherein:

said main housing includes a first mode control switch having an activated and an inactivated position;

said main housing further including a main module circuit control means operatively associated with said control signal generating means so as to receive a control signal from said control signal generating means in response to activation of said audio function switch;

said main module circuit control means further operatively associated with said first mode control switch so as to receive a control signal in response to said first mode control switch being in said activated position;

said main module circuit control means further operatively associated with said main module circuit whereby said main module circuit control means controls propagation of audio signals from said output port to said main module circuit, said main module circuit control means allowing propagation of audio signals from said output port to said main module circuit in response to simultaneous receipt of a control signal from said first mode control switch and a control signal from said control signal generating means;

said tape recorder connecting to said receiver through said main module circuit;

said main housing further including a second mode control switch, said second mode control switch having an activated and an inactivated position;

said main module circuit control means operatively connected to said second mode control switch so as to receive a signal from said second mode control switch in response to said second mode control switch being in its activated position;

said tape recorder including a recording control switch having an activated and an inactivated position;

said main module circuit control means operatively connected to said recording control switch so as to receive a signal from said recording control switch in response to said recording control switch being in its activated position;

said main module circuit control means allowing propagation of receiver output signals from said receiver to said recording means in response to simultaneous receipt by said main module circuit control means of a signal from said second mode control switch and said recording control switch.

* * * * *